United States Patent [19]

Gerritsen et al.

[11] 4,435,317

[45] Mar. 6, 1984

[54] DISHWASHING LIQUID INCLUDING ALKYL SULFATE, ALKYL ETHER SULFATE, ALKYLBENZENE SULFONATE AND MAGNESIUM

[75] Inventors: Jan Gerritsen, Strombeek-Bever, Belgium; Ronald E. Atkinson, Hexhan; Anthony F. Martin, Blyth; Mark R. Atkins, Gosforth of England

[73] Assignee: The Procter & Gamble Company, Cincinnati, Ohio

[21] Appl. No.: 460,967

[22] Filed: Jan. 25, 1983

Related U.S. Application Data

[63] Continuation of Ser. No. 255,405, Apr. 20, 1981, abandoned.

[30] Foreign Application Priority Data

Apr. 24, 1980 [GB] United Kingdom ..... 8013627
Oct. 20, 1980 [GB] United Kingdom ..... 8033730

[51] Int. Cl.[3] ..... C11D 1/37; C11D 1/831

[52] U.S. Cl. ..... 252/547; 252/545; 252/548; 252/550; 252/551; 252/553; 252/558; 252/DIG. 14

[58] Field of Search ..... 252/550, 551, 552, 553, 252/558, DIG. 14, 547, 548, 545

[56] References Cited

U.S. PATENT DOCUMENTS

| | | | |
|---|---|---|---|
| 3,332,876 | 7/1967 | Walker | 252/553 X |
| 3,998,750 | 12/1976 | Payne et al. | 252/108 |
| 3,998,762 | 12/1976 | Murata et al. | 252/551 |
| 4,054,541 | 10/1977 | Mausner et al. | 252/532 |
| 4,064,076 | 12/1977 | Klisch et al. | 252/542 |
| 4,129,515 | 12/1978 | Foster | 252/117 |
| 4,133,779 | 1/1979 | Hellyer et al. | 252/547 |
| 4,169,076 | 9/1979 | Kawakami | 252/558 |
| 4,220,548 | 9/1980 | Hashimoto et al. | 252/106 |
| 4,235,752 | 11/1980 | Rosall et al. | 252/551 |

FOREIGN PATENT DOCUMENTS

| | | |
|---|---|---|
| 54-24906 | 2/1979 | Japan . |
| 1430610 | 3/1976 | United Kingdom . |
| 1518807 | 7/1978 | United Kingdom . |
| 1524441 | 9/1978 | United Kingdom . |
| 2010893A | 7/1979 | United Kingdom . |
| 1551074 | 8/1979 | United Kingdom . |

*Primary Examiner*—P. E. Willis, Jr.

[57] ABSTRACT

Physically stable liquid detergent compositions are provided comprising a mixture of alkyl sulphate, alkyl ether sulphate and alkylbenzene sulphonate surfactants in which the cations include a level of magnesium providing molar equivalence with the alkyl sulphate, together with a suds booster, preferably an alkyl ethanolamide.

17 Claims, No Drawings

DISHWASHING LIQUID INCLUDING ALKYL SULFATE, ALKYL ETHER SULFATE, ALKYLBENZENE SULFONATE AND MAGNESIUM

This is a continuation, of application Ser. No. 255,405, filed Apr. 20, 1981, now abandoned.

FIELD OF THE INVENTION

This invention relates to aqueous liquid detergent compositions and particularly to substantially unbuilt dishwashing detergent compositions incorporating a source of magnesium ions.

BACKGROUND OF THE INVENTION

The use of magnesium salts and magnesium surfactants in dishwashing detergent formulations is taught in the patent literature and the disclosures of British Pat. Specifications Nos. 1,524,441 and 1,551,074 and British published Patent Application No. 2,010,893 A are representative of the state of the art. The art teaches that these formulations have enhanced performance, particularly when used in water of low mineral hardness. Nevertheless products made in accordance with these teachings have all been found to be non-optimum in various ways such as raw material expense, phase stability on storage, performance in hard water, effect on hands and suds profile.

Accordingly the search has continued for compositions having improved economy, performance and in use characteristics and it has now been found that certain combinations of active ingredients can provide a range of enhanced properties not thought previously attainable in one formulation. More particularly it has been found possible to provide concentrated stable liquid dishwashing formulations of improved greasy soil removal, suds profile, viscosity and freeze-thaw characteristics.

The Applicants have found that compositions incorporating a ternary anionic surfactant mixture comprising alkyl benzene sulphonate, alkyl ether sulphate and alkyl sulphate, and in which part of the cation system is magnesium, produce the maximum suds mileage, i.e. number of dishes washed) when the magnesium level corresponds to the level of alkyl sulphate present.

Furthermore, in one aspect of the invention, it has been found possible to combine these characteristics with no sacrifice in the effect on hands relative to leading liquid dishwashing detergents available commercially.

An additional increment of sudsing performance is obtainable by the addition of a suds booster such as an alkyl alkanolamide. It had previously been believed that high levels of performance could only be obtained by the use of very high surfactant levels or by the use of high levels of suds boosters, which were expensive, difficult to incorporate and gave rise to phase stability problems on storage. The Applicants have found that surprisingly low suds booster levels viz. 3–4% provide a significant sudsing benefit in the formulations of the present invention and that, whilst levels of 6–8% can be used they offer little or no performance advantages over the lower levels.

Whilst the mechanism by which the compositions of the invention attain their enhanced performance is not fully understood and whilst the Applicants do not wish to be bound by any theory, it is believed that, in the ternary surfactant system employed in the compositions, magnesium is primarily associated with the alkyl sulphate in a polar ie. non-ionic bond arrangement and that this combination of the magnesium and alkyl sulphate, provides a more closely packed (and hence stable) structure in the suds. The effect of any additional suds booster is believed to be primarily of a suds-stabilising nature.

SUMMARY OF THE INVENTION

According to the present invention there is provided a physically stable aqueous liquid detergent composition consisting essentially of (a) from about 4% to about 24% by weight of the composition of a primary $C_{10}$–$C_{16}$ alkyl sulphate salt;

(b) from about 0.5% to about 20% by weight of the composition of a water-soluble $C_{10}$–$C_{16}$ primary alkyl ethoxy sulphate salt containing an average of from about 2 to about 6 ethylene oxide groups per alkyl group in the alkyl ether sulphate, and (c) from about 10% to about 28% by weight of the composition of a water-soluble substantially linear $C_{10}$–$C_{16}$ alkyl benzene sulphonate salt;

provided that the ratio of the total weight of components (a) and (c) to the weight of component (b) is $\leqq 33:1$, and that the composition contains magnesium ion in a molar amount corresponding to 0.20–0.70X where X is the number of moles of $C_{10}$–$C_{16}$ alkyl sulphate present.

Preferably the composition contains magnesium ion in an amount corresponding to 0.45–0.55X where X is defined as above.

Preferably the ratio of the total weight of alkylbenzene sulphonate and alkyl sulphate to the weight of alkyl ethoxy sulphate is $\leqq 14:1$ and in one aspect of the invention it is preferred that the ratio is $\leqq 5:1$.

In preferred embodiments of the invention the composition contains 2%–8% most preferably 3%–4% by weight of a suds booster selected from the group consisting of $C_{10}$–$C_{16}$ mono and di $C_2$–$C_3$ alkanolamide, $C_{12}$–$C_{14}$ alkyl amides condensed with up to 15 moles ethylene oxide per mole of amide, and $C_8$–$C_{18}$ alkyl di $C_1$–$C_3$ alkyl amine oxides.

In a highly preferred composition at least about 50% and preferably substantially 100% of the counter ions of components (b) and (c) above are ammonium ions and the chill point (as hereinafter defined) of the formulation is $<0°$ C.

DESCRIPTION OF THE INVENTION

Detergent compositions in accordance with the present invention comprise a mixture of three anionic surfactants of defined constitution in carefully controlled proportion.

The surfactant component of principal importance is a primary alkyl sulphate in which the alkyl group contains 10–16 carbon atoms, more preferably an average of about 12–14 carbon atoms preferably in a linear chain. $C_{10}$–$C_{16}$ alcohols, derived from natural fats or Ziegler olefin build-up or OXO synthesis, form suitable sources for the alkyl group. Examples of synthetically derived materials include Dobanol 23 (RTM) sold by Shell Chemicals (UK) Ltd, Ethyl 24 sold by the Ethyl Corporation, a blend of $C_{13}$–$C_{15}$ alcohols in the ratio 67% $C_{13}$, 33% $C_{15}$ sold under the trade name Lutensol by BASF GmbH and Synperonic (RTM) by ICI Ltd, and Lial 125 sold by Liquichimica Italiana SpA. Examples of naturally occurring materials from which the alcohols can be derived are coconut oil and palm kernel oil and the corresponding fatty acids.

The alkyl sulphate component is present at a level of from about 4% to about 24% by weight of the composition, more generally from about 6% to about 16% by weight. In a preferred aspect of the invention the usage level lies in the range from about 8% to about 12% by weight, most preferably in the range from about 9% to about 11% by weight.

For the purposes of the present invention the alkyl sulphate is associated with a source of magnesium ions which, as will be described hereinafter, can either be introduced as the oxide or hydroxide to neutralise the acid or can be added to the composition as a water soluble salt. However, the addition of appreciable levels of magnesium salts to the dishwashing compositions of the invention raises the temperature at which inorganic salt crystals form in the compositions on cooling and is therefore less preferable. The molar amount of magnesium ion in the compositions is controlled to correspond to 0.20–0.70X preferably 0.45–0.55X where X is the number of moles of $C_{10}$–$C_{16}$ alkyl sulphate present. Most preferable the magnesium ion content is adjusted to provide the stoichiometric equivalent of the alkyl sulphate present. In practice the magnesium ion will be present at a level of from about 0.15% to about 0.70% by weight preferably from about 0.35% to about 0.55% by weight of the composition.

The second anionic surfactant component comprises a primary alkyl ethoxy sulphate derived from the condensation product of a $C_{10}$–$C_{16}$ alcohol with an average of from about 2 to about 6 ethylene oxide groups. The $C_{10}$–$C_{16}$ alcohol itself can be obtained from any of the sources previously described for the alkyl sulphate component. It has however been found preferable to use alkyl sulphate and alkyl ether sulphate in which the carbon chain length distributions are the same. $C_{12}$–$C_{13}$ alkyl ether sulphates are preferred and the level of alkyl ethoxy sulphate in the compositions lies between about 0.5% and about 20% by weight of the compositions generally in the range from about 4% to about 14% by weight. In a preferred aspect of the invention the level lies in the range from about 9% to about 12% by weight, most preferably in the range from about 9% to about 11% by weight.

The conventional average degree of ethoxylation is about three groups per mole of alcohol, but as conventional ethoxylation processes result in a distribution of individual ethoxylates ranging from 1 to about 10 ethoxy groups per mole of alcohol, the average can be obtained in a variety of ways. Blends can be made of material having different degrees of ethoxylation and/or different ethoxylate distributions arising from the specific ethoxylation techniques employed and subsequent processing steps such as distillation. In fact, it has been found that equivalent sudsing and grease removal performance to that given by a blend of alkyl sulphate and alkyl triethoxy ether sulphate can be obtained by reducing the level of alkyl sulphate and using an alkyl ether sulphate with an average of approximately two ethoxy groups per mole of alcohol.

The counter ion for the alkyl ethoxy sulphate can be any one of sodium, potassium, ammonium or alkanolammonium or a mixture thereof. However for the purposes of obtaining the lowest possible chill point temperature, (the temperature at which inorganic salt crystals separate) it is desirable that at least about 50% of the counter ions for the alkyl ethoxy sulphate should be ammonium. In highly preferred compositions in accordance with the invention, the alkyl ethoxy sulphate is substantially completely neutralized by ammonium ions.

The alkyl benzene sulphonates forming component (c) of the present invention are those in which the alkyl group, which is substantially linear, contains from about 10 to about 16 carbon atoms, preferably from about 11 to 13 carbon atoms, a material with an average carbon chain length of 11.8 being most preferred. The phenyl isomer distribution, i.e. the point of attachment of the alkyl chain to the benzene nucleus, is not critical, but alkyl benzenes having a high 2-phenyl isomer content are preferred. For the purposes of the present invention, an alkylbenzene sulphonate content of from about 10% to about 28% by weight of the composition is required, generally from about 12% to about 26% by weight. In a preferred aspect of the invention an alkylbenzene sulphonate content of from about 14% to about 17% by weight is used and highly preferred compositions in accordance with this aspect of the invention have from about 15% to about 17% of $C_{11.8}$ alkyl benzene sulphonate. The counter ions in association with the alkyl benzene sulphonate are independently selected in the same manner as those for the alkyl ethoxy sulphate, there being preferably at least about 50% of ammonium ions. In order for compositions in accordance with the invention to have a chill point of $\leqq 0°$ C., at least about 70% of neutralising cations for the anionic surfactants should be ammonium ions and most preferably ammonium constitutes the only cation present other than magnesium.

Formulations in accordance with the present invention derive most of their sudsing and grease removal performance from the alkyl sulphate and alkylbenzene sulphonate components. The alkyl ether sulphate component provides phase stability for the formulation on storage and also prevents precipitation of insoluble surface active salts at usage concentrations (0.05%–0.2%) in water of high mineral hardness. In order to satisfy the stability requirements on storage and in use, the ratio of the total weight of alkyl benzene sulphonate and alkyl sulphate salts to the weight of alkyl ethoxy sulphate salts should not exceed about 33:1, and generally should not exceed about 14:1, there being relatively little benefit for ratios above about 14:1 over those below that ratio. Physically stable dishwashing liquid compositions having superior sudsing and grease cutting performance comprise from about 8% to about 12% preferably from about 9% to about 11% alkyl sulphate, from about 4% to about 8%, preferably from about 4% to about 6% alkyl ether sulphate and from about 22% to about 28%, preferably from about 24% to about 26% of alkyl benzene sulphonate.

When incorporated in the formulation at levels above the minimum necessary for phase stability, the alkyl ether sulphate component also improves the effect on hands. In a preferred aspect of the invention, in which liquid detergent compositions are formulated to provide optimum mildness to skin (i.e. effect on hands) consistent with enhanced sudsing and grease cutting capability, the ratio of the total weight of alkyl benzene sulphonate and alkyl sulphate to alkyl ether sulphate should be less than about 5:1 and preferably should lie in the range from about 2.0:1 to about 2.5:1.

A highly preferred ingredient of the composition according to the invention is a suds-promoting agent present at a level of from about 2% to about 8% by weight of the composition preferably from about 3% to about 6% and most preferably 3%–4%.

The suds-promoting agent can be any of $C_{10}$–$C_{16}$ mono- and di-$C_2$–$C_3$ alkanolamide, $C_{12}$–$C_{14}$ alkyl amides condensed with up to 15 moles of ethylene oxide per mole of amide and tertiary amine oxides containing a $C_8$–$C_{18}$ alkyl group.

Examples of the alkanolamides are coconut alkyl monoethanolamide, coconut alkyl diethanolamides and palm kernel and coconut alkyl mono and di isopropanolamides. The palm kernel or coconut alkyl residue may either be 'whole cut,' including the $C_{10}$ and $C_{16}$ fractions or may be the so-called 'narrow-cut' $C_{12}$–$C_{14}$ fraction. Synthetic sources of the $C_{10}$–$C_{16}$ alkyl group can also be used.

Examples of the ethoxylated amides include coconut alkyl amide condensed with six moles of ethylene oxide, lauryl amide condensed with eight moles of ethylene oxide, myristyl amide condensed with ten moles of ethylene oxide and coconut amide condensed with eight moles of ethylene oxide. Amine oxides useful in the present invention have one alkyl or hydroxyalkyl moiety of 8 to 18 carbon atoms, preferably 8 to 16 carbon atoms and two moieties selected from alkyl groups and hydroxyalkyl groups containing 1 to 3 carbon atoms. Examples of such materials include dimethyloctylamine oxide, diethyldecylamine oxide, bis-(2-hydroxyethyl) dodecylamine oxide, dimethyldodecylamine oxide, dipropyltetradecylamine oxide, methylethylhexadecylamine oxide, and dimethyl-2-hydroxyoctadecylamine oxide.

A highly preferred example of the tertiary amine oxide is a $C_{12}$–$C_{14}$ alkyl dimethyl amine oxide in which the $C_{12}$–$C_{14}$ alkyl group is derived from coconut oil.

The balance of the formula comprises a hydrotropewater system in which the hydrotrope may be urea, a $C_1$–$C_3$ alkanol, or a lower alkyl benzene sulphonate salt such as toluene-, cumene- or xylene-sulphonate or mixtures of any of these. Normally a single hydrotrope will be adequate to provide the required phase stability and viscosity characteristics, but compositions in which the total surfactant concentration exceeds about 45% may require a mixture such as urea-alcohol-water or alcohol-lower alkyl benzene sulphonate-water in order to remain stable and easily pourable. For compositions having an organic active concentration less than about 40% by weight the preferred hydrotrope is ethanol which is employed at from about 6% to about 10% by weight of the composition preferably at from about 7% to about 9%. Mixtures of hydrotropes can, of course, be used in compositions of lower surfactant concentration and may be employed for cost effectiveness reasons.

Optional ingredients of the liquid detergent compositions of the invention include opacifiers such as ethylene glycol distearate, thickeners such as guar gum, antibacterial agents such as glutaraldehyde and Bronopol (RTM), antitarnish agents such as benzotriazole, heavy metal chelating agents such as ETDA or ETDMP, perfumes and dyes. The pH of the compositions may be anywhere within the range from 6 to 7.5 but as manufactured the compositions normally have a pH in the range from 6.6 to 7.3. For coloured products the pH preferably lies in the range from 6.6 to 6.9 in order to maintain colour stability.

The technique of incorporation of the magnesium ions is not thought to be critical and the composition can be made in a number of ways.

Thus, individual anionic surfactants can be made as aqueous solutions of alkali metal or ammonium salts which are then mixed together with the suds booster and with the hydrotrope, following which the magnesium ion can be introduced as a water soluble salt such as the chloride or sulphate. Optional minor ingredients are then added before pH and viscosity are adjusted. This method has the advantage of utilising conventional techniques and equipment but does result in the introduction of additional chloride or sulphate ions which can increase the chill point temperature (the temperature at which inorganic salts precipitate as crystals in the liquid).

An alternative and preferred method is to mix the alcohol and alcohol ethoxylate together and carry out a single sulphation and neutralisation. For this, the alcohol and alcohol ethoxylate should be mixed in a weight ratio lying in the range from about 45:1 to about 1:5.5. Sulphation can take place by means of any of the conventional sulphating agents such as e.g. sulphur trioxide or chlorosulphonic acid. Neutralisation of the alkyl ether sulphuric acid and the alkyl sulphuric acid is carried out with a magnesium oxide or hydroxide slurry which avoids the addition of chloride or sulphate ions. Although not essential, it is convenient to use a mixture of these acids as the magnesium salt of the alkyl either sulphuric acid has relatively greater aqueous solubility than the alkyl sulphuric acid component. The alkyl benzene sulphonate salt is neutralised separately and in a highly preferred technique, is used together with the hydrotrope as 'heel' for the neutralisation of the other surfactants. The neutralised surfactant salts and the hydrotrope are then added to the final mixing tank and the suds booster and any optional ingredients added before the pH is adjusted as above.

Preferred compositions in accordance with the invention are clear single phase liquids, but the invention also embraces opaque products containing dispersed phases provided that such products are physically stable (i.e. do not separate) on storage.

Typical composition ranges for the present invention are:

(a) 8–9% $C_{12}$–$C_{14}$ alkyl sulphate, 10–11% $C_{12}$–$C_{14}$ alkyl $(EO)_2$ sulphate, 14–15% $C_{11.8}$ alkyl benzene sulphonate, 3–4% narrow cut coconut alkyl ethanolamide, (b) 11–12% $C_{12}$–$C_{14}$ alkyl sulphate, 11–12% $C_{12}$–$C_{14}$ alkyl $(EO)_3$ sulphate, 14–15% $C_{11.8}$ alkyl benzene sulphonate, 3–4% narrow cut coconut alkyl ethanolamide, (c) 9–11% $C_{12}$–$C_{14}$ alkyl sulphate, 9–11% $C_{12}$–$C_{14}$ alkyl $(EO)_3$ sulphate, 15–17% $C_{11.8}$ alkyl benzene sulphonate, 3–4% whole cut coconut alkyl ethanolamide, (d) 9–11% $C_{12}$–$C_{14}$ alkyl sulphate, 4–6% $C_{12}$–$C_{14}$ alkyl $(EO)_3$ sulphate, 24–26% $C_{11}$–$C_{13}$ alkyl benzene sulphonate.

The invention is illustrated in the following examples in which the percentages of the components are by weight based on the finished composition.

EXAMPLE 1

The following composition is made up.

| | | |
|---|---|---|
| $C_{12-13}$ Alkyl sulphate[1] | 11.8 | incorporation |
| $C_{12-13}$ alkyl $(EO)_3$ sulphate[2] | 11.4 | 1.24 parts $NH_4^+$ |
| $C_{11.8}$ linear alkyl benzene[3] sulphonate | 14.2 | ion and 0.50 parts $Mg^{++}$ ion, the |
| Narrow cut coconut mono-ethanolamide | 3.0 | level of $Mg^{++}$ corresponding to |
| Ethanol | 9.0 | 0.5X where X is |
| Perfume, Colour and Miscellaneous | 1.0 | the number of moles of alkyl |
| Water | to 100 | sulphate. |

[1]Derived from Dobanol 23 (RTM) a $C_{12}$–$C_{13}$ primary alcohol sold by Shell Chemicals.
[2]Derived from Dobanol 23.3 (RTM) a $C_{12}$–$C_{13}$ primary alcohol condensed with an average of three ethylene oxide groups per mole of alcohol sold by Shell Chemicals.
[3]Derived from Sirene XL 12, a linear alkyl benzene sold by SIR Italy.

The alkyl benzene sulphonate is formed by $SO_3$ sulphonation of the alkyl benzene. The alkyl sulphate and alkyl ether sulphate are formed by $SO_3$ sulphation of a blend of the alcohol and alcohol ether condensate and the mixed sulphuric acids are neutralised in a heel of water, ethanol all of the magnesium hydroxide required and approximately 60% of the ammonia. The sulphonic acid is then added to this mixture, followed by the remainder of the ammonia in order to bring the pH to neutrality. Minor ingredients are added to the mixture and the composition is then pH trimmed with citric acid to give a pH of 6.6 before the viscosity is adjusted to 200 cp.

EXAMPLE II

The following composition is prepared using the same materials as in Example 1.

| | | |
|---|---|---|
| $C_{12-13}$ Alkyl sulphate | 9.6 | incorporating 1.24 |
| $C_{12-13}$ Alkyl $(EO)_3$ sulphate | 11.4 | parts $NH_4^+$ ion and |
| $C_{11.8}$ linear alkyl benzene sulphonate | 14.2 | 0.41 parts $Mg^{++}$ ion, the level of $Mg^{++}$ |
| Narrow cut Coconut mono-ethanolamide | 4.0 | corresponding to 0.5X where X is the |
| Ethanol | 8.0 | number of moles of |
| Minors | 1.3 | alkyl sulphate. |
| Water | 51.5 | |

The alkyl benzene is sulphonated and neutralised with a heel of ammonia, water and ethanol to form ammonium alkyl benzene sulphonate. The $C_{12}$–$C_{13}$ alcohol and the $C_{12}$–$C_{13}$ alcohol ethylene oxide condensate are blended together and sulphated using chlorosulphonic acid and neutralised using the previously formed alkyl benzene sulphonate solution as a heel to which magnesium hydroxide and additional water have been added. After reaction the pH of the paste is approximately 2.0 and is raised to 6.0 using additional ammonia. The coconut monoethanol amide is then added to this mixture followed by the balance of the water and the minor ingredients. Finally the pH is trimmed to 6.6 using citric acid and the viscosity adjusted to 200 cp.

EXAMPLE III

A composition having the following formulation is prepared using the method and materials of Example II.

| | | |
|---|---|---|
| $C_{12-13}$ alkyl sulphate | 9.6 | incorporating 1.24 |
| $C_{12-13}$ alkyl $(EO)_3$ sulphate | 9.6 | parts $NH_4^+$ ion and |
| $C_{11.8}$ linear alkyl benzene sulphonate | 16.0 | 0.40 parts $Mg^{++}$ ion, the level of $Mg^{++}$ |
| Whole cut coconut mono-ethanolamide | 4.0 | corresponding to 0.5X where X is the |

-continued

| | | |
|---|---|---|
| Ethanol | 8.0 | number of moles of |
| Minors | 1.3 | alkyl sulphate. |
| Water | 51.5. | |

EXAMPLE IV

A composition having the following formulation is prepared using the method and materials of Example I.

| | | |
|---|---|---|
| $C_{12}$–$C_{13}$ alkyl sulphate | 10.9 | incorporating 1.47 parts |
| $C_{12}$–$C_{13}$ alkyl $(EO)_3$ sulphate | 4.9 | $NH_4^+$ ion and 0.46 parts |
| $C_{11.8}$ linear alkyl benzene sulphonate | 24.2 | $Mg^{++}$ ion, the level corresponding to 0.5X |
| Ethanol | 8.0 | where X is the number of |
| Minors | 1.5 | moles of alkyl sulphate. |
| Water | 50.5 | |

EXAMPLE V

The following composition was prepared using the method of Example II.

| | | |
|---|---|---|
| $C_{12}$–$C_{13}$ alkyl sulphate | 8.6 | incorporating 1.24 parts |
| $C_{12}$–$C_{13}$ alkyl $(EO)_2$ sulphate | 10.4 | $NH_4^+$ ion and 0.37 parts $Mg^{++}$ ion. |
| $C_{11.8}$ linear alkyl benzene sulphonate | 14.2 | |
| Whole cut coconut mono ethanolamide | 4.0 | |
| Ethanol | 10.0 | |
| Minors and Water | to 100 | |

We claim:

1. A physically stable aqueous liquid detergent composition consisting essentially of (a) from about 6% to about 16% by weight of the composition of a primary $C_{10}$–$C_{16}$ alkyl sulphate salt;

(b) from about 0.5% to about 20% by weight of the composition of a water-soluble $C_{10}$–$C_{16}$ primary alkyl ethoxy sulphate salt containing an average of from about 2 to about 6 ethylene oxide groups per alkyl group in the alkyl ether sulphate, and (c) from about 10% to about 28% by weight of the composition of a water-soluble substantially linear $C_{10}$–$C_{16}$ alkyl benzene sulphonate salt;

provided that the ratio of the total weight of components (a) and (c) to the weight of component (b) is $\leqq 33:1$, and that the composition contains magnesium ion in a molar amount corresponding to 0.45–0.55X where X is the number of moles of $C_{10}$–$C_{16}$ alkyl sulphate present.

2. The composition of claim 1 containing magnesium ion in an amount corresponding to the stoichiometric equivalent of the alkyl sulphate.

3. A liquid detergent composition according to claim 1 wherein the ratio of the total weight of components (a) and (c) to component (b) is $\leqq 14:1$.

4. A liquid detergent composition according to claim 3 wherein the weight of component (a) is from about 8 % to about 12%, the weight of component (b) is from about 4% to about 8% and the weight of component (c) is from about 22% to about 28%.

5. A liquid detergent composition according to claim 4 wherein at least about 50% of the counter ions of components (b) and (c) are ammonium groups.

6. A liquid detergent composition according to claim 5 wherein substantially 100% of the counter ions of components (b) and (c) are ammonium groups.

7. A liquid detergent composition according to claim 3 wherein the ratio of the total weight of components (a) and (c) to component (b) is $\leqq 5:1$.

8. A liquid detergent composition according to claim 7 consisting essentially of (a) from about 8% to about 12% by weight of a primary $C_{12}$–$C_{14}$ alkyl sulphate salt;

(b) from about 9% to about 11% by weight of a water soluble $C_{12}$–$C_{14}$ alkyl ether sulphate salt containing an average of from about 2 to about 6 ethylene oxide groups per alkyl group in the alkyl ether sulphate;

(c) from about 14% to about 17% by weight of a water soluble substantially linear $C_{11}$–$C_{12}$ alkyl benzene sulphonate salt; and (d) from about 2% to about 8% by weight of a suds booster selected from the group consisting of $C_{10}$–$C_{16}$ mono- and di-$C_2$–$C_3$ alkanolamides, $C_{12}$–$C_{14}$ alkyl amides condensed with up to about 15 moles ethylene oxide per mole of amide, and $C_8$–$C_{18}$ alkyl di-$C_2$–$C_3$ alkyl amine oxides.

9. A liquid detergent composition according to claim 8 wherein at least about 50% of the counter ions of components (b) and (c) are ammonium groups.

10. A liquid detergent composition according to claim 9 wherein substantially 100% of the counter ions of components (b) and (c) are ammonium groups.

11. A liquid detergent composition according to claim 1, in which the weight of component (a) ranges from about 6% to about 16%, the weight of component (b) ranges from about 4% to about 14%, the weight of component (c) ranges from about 14% to about 17%, and the magnesium is present in an amount corresponding to 0.45–0.55X.

12. A liquid detergent composition according to claim 11, in which the weight of component (a) ranges from about 8% to about 12% and in which the weight of component (b) ranges from about 9% to about 12%.

13. The composition of claim 11 containing magnesium ion in an amount corresponding to the stoichiometric equivalent of the alkyl sulphate.

14. The composition of claim 12 containing magnesium ion in an amount corresponding to the stoichiometric equivalent of the alkyl sulphate.

15. A clear single phase liquid detergent composition consisting essentially of (a) from about 8% to about 9% of a primary $C_{12}$–$C_{14}$ alkyl sulphate salt;

(b) from about 10% to about 11% of a primary $C_{12}$–$C_{14}$ alkyl ether sulphate salt containing an average of about two ethoxy groups per alkyl group in the alkyl ether sulphate;

(c) from about 14% to about 15% of a substantially linear $C_{11}$–$C_{12}$ alkyl benzene sulphonate salt, and (d) from about 3% to about 4% of a suds booster selected from $C_{10}$–$C_{16}$ alkyl mono ethanolamides, and $C_{12}$–$C_{14}$ alkyl dimethyl amine oxides;

wherein the composition contains magnesium ion in a molar amount corresponding to 0.45–0.55X where X is the number of moles of $C_{12}$–$C_{14}$ alkyl sulphate present and substantially all of the counter ions other than the magnesium are ammonium groups.

16. A liquid detergent composition according to claim 15 which has a chill point of $<0°$ C.

17. The composition of claim 15 containing magnesium ion in an amount corresponding to the stoichiometric equivalent of the alkyl sulphate.

* * * * *